US011051107B2

(12) United States Patent
Lafort et al.

(10) Patent No.: US 11,051,107 B2
(45) Date of Patent: Jun. 29, 2021

(54) MINIATURE RECEIVER

(71) Applicant: Sonion Nederland B.V., Hoofddorp (NL)

(72) Inventors: Adrianus Maria Lafort, Hoofddorp (NL); Rasmus Voss, Hoofddorp (NL); Dennis Jacobus Mattheus Mocking, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 16/424,761

(22) Filed: May 29, 2019

(65) Prior Publication Data

US 2019/0379978 A1 Dec. 12, 2019

(30) Foreign Application Priority Data

Jun. 7, 2018 (EP) ..... 18176536

(51) Int. Cl.
*H04R 7/02* (2006.01)
*H04R 19/04* (2006.01)

(52) U.S. Cl.
CPC ..... *H04R 7/02* (2013.01); *H04R 19/04* (2013.01); *H04R 2201/003* (2013.01)

(58) Field of Classification Search
CPC ..... H04R 7/02; H04R 19/04; H04R 2201/003
USPC ..... 381/174, 175, 176
See application file for complete search history.

(56) References Cited

U.S. PATENT DOCUMENTS 6,563,933 B1 * 5/2003 Niederdraenk ..... H04R 11/02 381/396
6,788,796 B1 9/2004 Miles
6,831,577 B1 12/2004 Furst
6,853,290 B2 2/2005 Jorgensen
6,859,542 B2 2/2005 Johannsen
6,888,408 B2 5/2005 Furst
6,914,992 B1 7/2005 van Halteren
6,919,519 B2 7/2005 Ravnkilde
6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,062,058 B2 6/2006 Steeman
7,062,063 B2 6/2006 Hansen
7,072,482 B2 7/2006 van Doorn
(Continued)

FOREIGN PATENT DOCUMENTS

CN 206640790 U 11/2017
WO WO 2017069057 A1 9/2018

OTHER PUBLICATIONS

Extended European Search Report for Application No. EP 18176536.3, dated Nov. 20, 2018 (4 pages).

*Primary Examiner* — Alexander Krzystan
*Assistant Examiner* — Julie X Dang
(74) *Attorney, Agent, or Firm* — Nixon Peabody LLP

(57) ABSTRACT

A miniature receiver including a first moveable diaphragm being acoustically connected to an intermediate volume, and a second moveable diaphragm being acoustically connected to the intermediate volume and a rear volume. The acoustic compliance of the intermediate volume is smaller than the acoustic compliances of the respective first and second moveable diaphragms. An associated method is also disclosed.

13 Claims, 9 Drawing Sheets

(56) References Cited

U.S. PATENT DOCUMENTS 7,088,839 B2 8/2006 Geschiere
7,110,560 B2 9/2006 Stenberg
7,136,496 B2 11/2006 van Halteren
7,142,682 B2 11/2006 Mullenborn
7,181,035 B2 2/2007 van Halteren
7,190,803 B2 3/2007 van Halteren
7,206,428 B2 4/2007 Geschiere
7,221,767 B2 5/2007 Mullenborn
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 1/2012 van Halteren
8,101,876 B2 1/2012 Andreasen
8,103,039 B2 1/2012 van Halteren
8,160,290 B2 4/2012 Jorgensen
8,170,249 B2 5/2012 Halteren
8,189,804 B2 5/2012 Hruza
8,189,820 B2 5/2012 Wang
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,379,899 B2 2/2013 van Halteren
8,509,468 B2 8/2013 van Halteren
8,526,651 B2 9/2013 Lafort
8,526,652 B2 9/2013 Ambrose
2007/0291971 A1* 12/2007 Halteren ..... H04R 25/48 381/322
2009/0296971 A1* 12/2009 Saltykov ..... H04R 25/48 381/351
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0053393 A1 3/2012 Kaltenbacher
2012/0140966 A1 6/2012 Mocking
2012/0155683 A1 6/2012 van Halteren
2012/0155694 A1 6/2012 Reeuwijk
2012/0255805 A1* 10/2012 van Halteren ..... H04R 11/02 181/199
2013/0028451 A1 1/2013 de Roo
2013/0136284 A1 5/2013 van Hal
2013/0142370 A1 6/2013 Engbert
2013/0163799 A1 6/2013 Van Halteren
2013/0195295 A1 8/2013 van Halteren
2014/0112509 A1* 4/2014 Lafort ..... H04R 1/406 381/322
2016/0050506 A1* 2/2016 Kim ..... H04R 7/08 381/56
2016/0219362 A1* 7/2016 Litovsky ..... H04R 1/2834
2018/0058963 A1* 3/2018 Wagner ..... G01L 9/0054
2018/0070168 A1* 3/2018 Han ..... H04R 1/2842
2018/0242087 A1 8/2018 Miyoshi

* cited by examiner

MINIATURE RECEIVER

FIELD OF THE INVENTION

The present invention relates to a miniature receiver comprising at least first and second moveable diaphragms being acoustically connected via an intermediate volume having an acoustic compliance being smaller than the acoustic compliances of the respective first and second moveable diaphragms.

BACKGROUND OF THE INVENTION

The achievable sound pressure level (SPL) from receiver depends on a variety of parameters—one of them being the effective area of the moveable diaphragm of the receiver. A larger membrane area facilitates a larger SPL for a given membrane displacement. Thus, in order to enable large effective diaphragm areas, it can be useful to have multiple diaphragms in a receiver. These diaphragms are normally placed in parallel, both acoustically and electrically.

For a receiver with a substantially enclosed back volume, the acoustic back volume compliance can play a large role in optimizing a receiver for high SPL. A general rule is that the combined compliance of the motor and diaphragm should be similar to the acoustic back volume compliance.

For this reason, receivers with larger or multiple diaphragms need very high stiffness membranes or motors. This may however reduce the efficiency of driving the diaphragms.

In view of the above remarks it may be seen as an object of embodiments of the present invention to provide a miniature receiver being capable of generating a larger SPL.

It may be seen as a further object of embodiments of the present invention to provide a miniature receiver comprising a plurality of moveable diaphragms being acoustically coupled in series.

DESCRIPTION OF THE INVENTION

The above-mentioned object is complied with by providing, in a first aspect, a miniature receiver comprising a first moveable diaphragm being acoustically connected to an intermediate volume, and a second moveable diaphragm being acoustically connected to the intermediate volume and a rear volume wherein the acoustic compliance of the intermediate volume is smaller than the acoustic compliances of the respective first and second moveable diaphragms.

In the present context the term "miniature receiver" should be understood as a sound generating receiver having a size that allows it to be applied in ear pieces of for example hearing aids or hearables, such as a hearing device to be carried near or outside an ear, or at least partly inside an ear canal.

Moreover, the term "moveable diaphragm" should, in the present context, be understood as a moveable or deformable mechanical element, or a combination of a plurality of moveable and/or deformable elements, being acoustically coupled to air on both sides so that movements of a moveable diaphragm, or parts thereof, displaces the air in sections of an acoustical frequency band.

The low acoustic compliance of the intermediate volume relative to the acoustic compliances of the first and second moveable diaphragms ensures that movements of the first and second moveable diaphragms are coupled through a substantially stiff connection. A movement of one diaphragm in one direction will thus provide a force in the same direction to the other diaphragm. The intermediate volume thus acts as a stiff connection between the first and second moveable diaphragms thus transferring forces between them as well as ensuring that the first and second moveable diaphragms perform similar volume displacements in response to an applied electrical drive signal.

The miniature receiver of the present invention may further comprise a front volume, wherein a first surface of the first moveable diaphragm is acoustically connected to the front volume, and wherein an opposing second surface of the first moveable diaphragm is acoustically connected to the intermediate volume, and wherein a first surface of the second moveable diaphragm is acoustically connected to the intermediate volume, and wherein an opposing second surface of the second moveable diaphragm is acoustically connected to the rear volume.

The front volume may be acoustically connected to a sound outlet of the miniature receiver so that generated sound is allowed to leave the miniature receiver.

For typical miniature receivers the total volume may be in the range 10-400 $mm^3$. For such miniature receivers the front volume, the rear volume, and the intermediate volume may be 2-20%, 2-20% and 25-80% of the total volume, respectively.

In contrast to the front volume the intermediate and rear volumes may constitute substantially closed volumes.

The first moveable diaphragm may form part of a first microelectromechanical system (MEMS) die, whereas the second moveable diaphragm may form part of a second MEMS die. The first and second MEMS dies may be arranged on opposing surfaces of a substrate at least partly separating the front and rear volumes of the miniature receiver. In particular, the first and second MEMS dies may be aligned with an opening in the substrate in a manner so that the first and second moveable diaphragms cover the opening in the substrate.

Alternatively, the first and second moveable diaphragms may form part of the same MEMS die.

The first and/or second moveable diaphragms may each comprise a substantially plane diaphragm. Moreover, the first and/or second moveable diaphragms may each comprise an integrated drive structure adapted to displace the first and/or second moveable diaphragms in response to one or more electrical drive signals applied to said integrated drive structures. The integrated drive structure of each of the first and/or second moveable diaphragms may comprise a piezoelectric material layer arranged between a first and a second electrode. Alternatively, the first and/or second moveable diaphragms may each comprise a substantially plane electrostatic diaphragm.

Alternatively, a separate drive structure, such as a separate piezoelectric driver or a balanced armature, may be applied to drive the first and second moveable diaphragms in response to one or more electrical drive signals applied to said separate drive structures.

The first and second moveable diaphragms may comprise respective first and second substantially plane diaphragms, said first and second substantially plane diaphragms being structurally arranged in a substantially parallel manner. Alternatively, the first and second moveable diaphragms may be arranged at an angle relative to each other. This angle may be up to 20 degrees.

The first and second electrodes of the respective first and second moveable diaphragms may electrically be coupled in parallel. With this arrangement the integrated drive structures of the first and second moveable diaphragms will receive the same electrical drive signal during operation.

Although the miniature receiver has being disclosed as having two moveable diaphragms it should be noted that the miniature receiver may further comprise additional moveable diaphragms being arranged in series with the first and second moveable diaphragms disclosed above. Also, moveable diaphragms in series may be combined with other moveable diaphragms via a parallel implementation, such as two moveable diaphragms in series being in parallel with a third moveable diaphragm.

In a second aspect the present invention relates to a personal device comprising a miniature receiver according to the first aspect, said personal device being selected from the group consisting of hearing aids, hearing devices, hearables, mobile communication devices and tablets.

In a third aspect the present invention relates to a method for operating a miniature receiver comprising a first moveable diaphragm being acoustically connected to an intermediate volume, and a second moveable diaphragm being acoustically connected to the intermediate volume and a rear volume, wherein the acoustic compliance of the intermediate volume is smaller than the acoustic compliances of the respective first and second moveable diaphragms, the method comprising the steps of operating the first and second moveable diaphragms in accordance with one or more electrical drive signals.

The miniature receiver may be implemented as discussed in connection with the first aspect of the present invention. Thus, a first surface of the first moveable diaphragm is acoustically connected to a front volume, and an opposing second surface of the first moveable diaphragm is acoustically connected to the intermediate volume. Moreover, a first surface of the second moveable diaphragm is acoustically connected to the intermediate volume, and an opposing second surface of the second moveable diaphragm is acoustically connected to the rear volume.

As discussed previously the first moveable diaphragm may form part of a first MEMS die, and the second moveable diaphragm may form part of a second MEMS die. Alternatively, the first and second moveable diaphragms may form part of the same MEMS die.

The first and second moveable diaphragms may each comprise a substantially plane diaphragm comprising an integrated drive structure. The integrated drive structure of each of the first and second moveable diaphragms may comprise a piezoelectric material layer arranged between a first and a second electrode. The first and second electrodes of the respective first and second moveable diaphragms may electrically be coupled in parallel. With this arrangement the integrated drive structures of the first and second moveable diaphragms will receive the same electrical drive signal during operation.

BRIEF DESCRIPTION OF THE DRAWINGS

The present invention will now be explained in further details with reference to the accompanying figures, wherein FIG. 1 which shows the general concept of the present invention, FIG. 2 shown a piezoelectric diaphragm.

Figure 1:
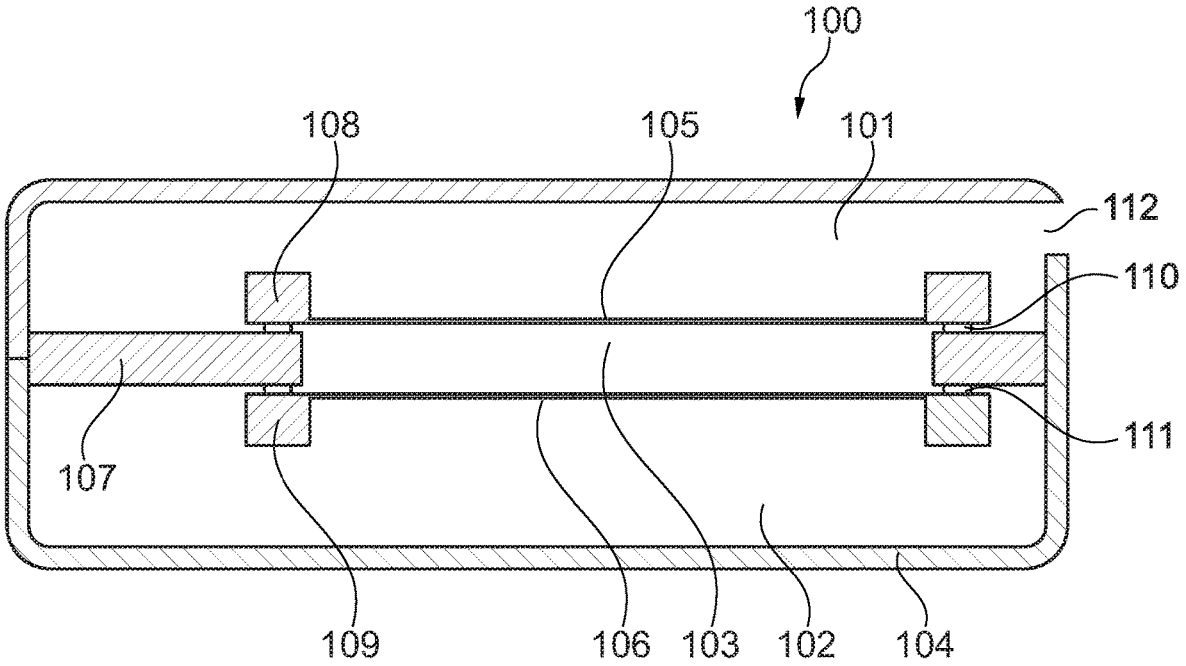

While the invention is susceptible to various modifications and alternative forms specific embodiments have been shown by way of examples in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a miniature receiver comprising first and second moveable diaphragms being acoustically connected via an intermediate volume having an acoustic compliance which is smaller than the respective acoustic compliances of the first and second moveable diaphragms. The smaller acoustic compliance of the intermediate volume relative to the acoustic compliances of the first and second moveable diaphragms ensure that the first and second moveable diaphragms are driven in the same direction and perform the same volume displacements in response to an applied electrical drive signal.

The miniature receiver of the present invention is advantageous in that it improves the SPL compared to conventional receivers having a substantially closed rear volume. In relation to the miniature receiver according to the present invention the compliance of the moveable diaphragm or diaphragms are of the same order of magnitude as an acoustic load which is dominated by the compliance of the rear volume. The miniature receiver of the present invention is thus advantageous for the following reasons:

1) Extra degrees of freedom to increase active diaphragm area, i.e. it is easier to find and allocate space for more diaphragm area when the moveable diaphragms are arranged in series.

2) Extra freedom in terms of optimization of the miniature receiver in that the ratio of receiver stiffness to the rear volume stiffness may be optimized which allows for more compliant diaphragm designs.

Referring now to FIG. 1 a miniature receiver 100 according to the present invention is depicted. As seen in FIG. 1 the miniature receiver 100 comprises a housing 104 and a sound outlet 112 arranged therein. The sound outlet 112 is acoustically connected to a front volume 101 which is acoustically sealed from a rear volume 102 via a substrate 107 and first and second MEMS dies 108, 109. The MEMS dies 108, 109 are both aligned with an opening in the substrate 107 as well as secured to the substrate 107 via respective die attachments 110, 111.

As seen in FIG. 1 a first moveable diaphragm 105 forms part of the MEMS die 108, whereas a second moveable diaphragm 106 forms part of the MEMS die 109. The first and second moveable diaphragms 105, 106 are arranged in a substantially parallel manner.

As seen in FIG. 1 an upper surface of the first moveable diaphragm 105 is acoustically connected to the front volume 101, whereas the opposing lower surface of the first moveable diaphragm 105 is acoustically connected to the intermediate volume 103. Similarly, an upper surface of the second moveable diaphragm 106 is acoustically connected to the intermediate volume 103, whereas an opposing lower surface of the second moveable diaphragm 106 is acoustically connected to the rear volume 102.

As previously addressed the intermediate volume 103 has an acoustic compliance which is smaller than the respective acoustic compliances of the first and second moveable diaphragms 105, 106. The smaller acoustic compliance of the intermediate volume 103 relative to the acoustic compliances of the first and second moveable diaphragms 105, 106 ensure that the first and second moveable diaphragms are driven in the same direction and perform the same volume displacements in response to an applied electrical drive signal.

The first and second moveable diaphragms 105, 106 each comprises an integrated drive structure being adapted to displace the first and second moveable diaphragms 105, 106 in response to an applied electrical drive signal. Although not shown in FIG. 1 the integrated drive structure of each of the first and second moveable diaphragms 105, 106 may comprise a piezoelectric material layer being arranged between a first and a second electrode. The first and second electrodes of the respective first and second moveable diaphragms are electrically coupled in parallel so that an electrical drive signal applied to the first moveable diaphragm 105 is also applied to the second moveable diaphragm 106.

Figure 2:
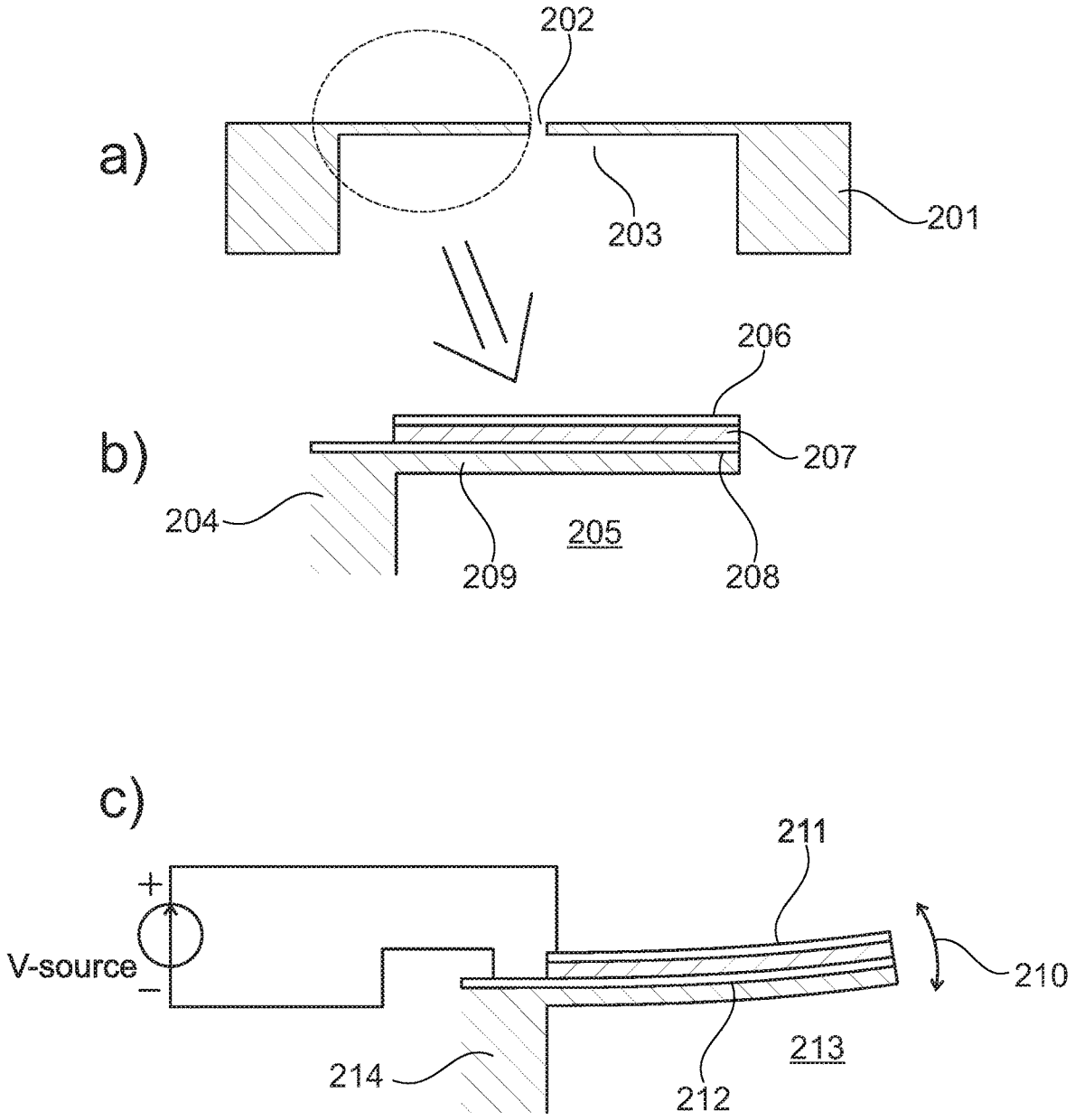
Figure 3:
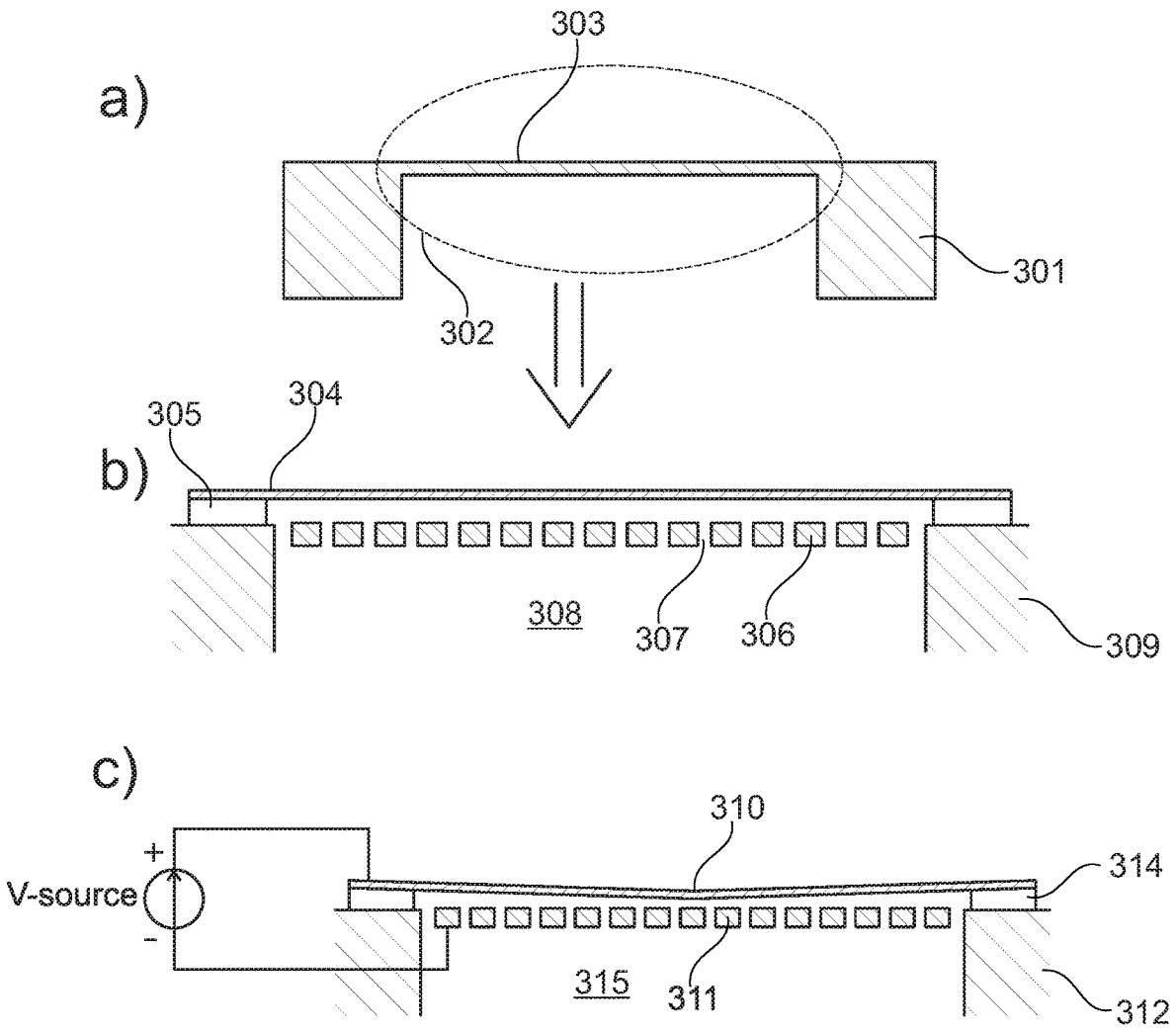
FIG. 3 shows an electrostatic driven diaphragm.

The piezoelectric arrangement for driving the first and second moveable diaphragms 105, 106 may be implemented as depicted in FIG. 2. Alternatively, the drive mechanism for driving the first and second moveable diaphragms 105, 106 may be implemented as an electrostatic arrangement each having an associated backplate as depicted in FIG. 3.

In the embodiment shown in FIG. 2 piezoelectric levers 203 forming a moveably diaphragm are depicted. The moveable diaphragm may be any of the moveable diaphragms 105, 106 in FIG. 1. The piezoelectric levers 203 are secured to a MEMS bulk 201. An opening or gap 202 is provided in the centre portion, cf. FIG. 2*a*. The gap 202 between the levers 203 is so narrow that the acoustic leakage through the gap is not affecting the acoustic output in the audible frequency range. The piezoelectric levers 203 thus effectively behave as a sealed diaphragm. The acoustic leakage through the gap determines the low frequency roll-off of the acoustic output of the miniature receiver.

FIG. 2*b* shows an enlarged view of the encircled portion of FIG. 2*a*. As depicted in FIG. 2*b* the piezoelectric lever forms a layered structure comprising a piezoelectric material 207 arranged between two electrodes 206, 208. The electrodes 206, 208 are adapted to be connected to a voltage source, cf. FIG. 2*c*. An elastic layer 209 is secured to the electrode 208 and forms an integral part of the MEMS bulk 204 and define a volume 205 in combination therewith. The volume 205 forms part of either the front volume 101 or the rear volume 102, cf. FIG. 1.

FIG. 2*c* shows the piezoelectric lever in a deflected position as indicated by the arrow 210. The deflection of the piezoelectric levers is provided by applying a voltage to the electrodes 211, 212 whereby the levers deflect either up or down depending of the polarity of the applied voltage. Again, the volume 213 is provided below the levers. Since the gap between the levers is so narrow that the levers behave as a moveable diaphragm for the audible frequency range, a sound pressure can be generated when an appropriate drive signal/voltage applied to the electrodes 211, 212. Alternatively, if a moveable diaphragm is secured to the piezoelectric lever and an appropriate drive signal/voltage applied to the electrodes 211, 212 sound pressure variations may be generated. Such a separate diaphragm may be a polymer diaphragm, a metal diaphragm or a composite, and can be comprised of rigid regions and compliant regions.

FIG. 3 shows an alternative drive mechanism for the first and second moveable diaphragms 105, 106 of FIG. 1. In FIG. 3*a* an electrostatically actuated diaphragm having an associated backplate is depicted. With reference to FIG. 3*a* an electrically conducting diaphragm 303, a MEMS bulk 301 and a volume 302 are depicted. The volume 302 forms part of either the front volume 101 or the rear volume 102, cf. FIG. 1. FIG. 3*b* shows an enlarged version of FIG. 3*a*. As seen in FIG. 3*b* the diaphragm 304 is arranged on a spacer 305 so that a distance to a backplate 306 with perforations 307 is ensured. The MEMS bulk 309, which supports the diaphragm 304 and the spacer 305, defines in combination with the backplate 306, the volume 308. In FIG. 3*c* a voltage source has been connected to the electrically conducting diaphragm 310 and the perforated backplate 311 above the volume 315. As depicted in FIG. 3*c* the applied voltage causes the diaphragm 310 to deflect in the direction of the backplate 311. With an appropriate drive signal/voltage applied between the diaphragm 310 and the perforated backplate 311 sound pressure variations may be generated. As previously mentioned the diaphragm 310 is supported by the MEMS bulk 312 via the spacer 314.

In relation to FIG. 3 it should be noted that the electret based structures may be applied as well. In the following various embodiments of MEMS dies as well as combinations thereof are discussed.

Figure 4:
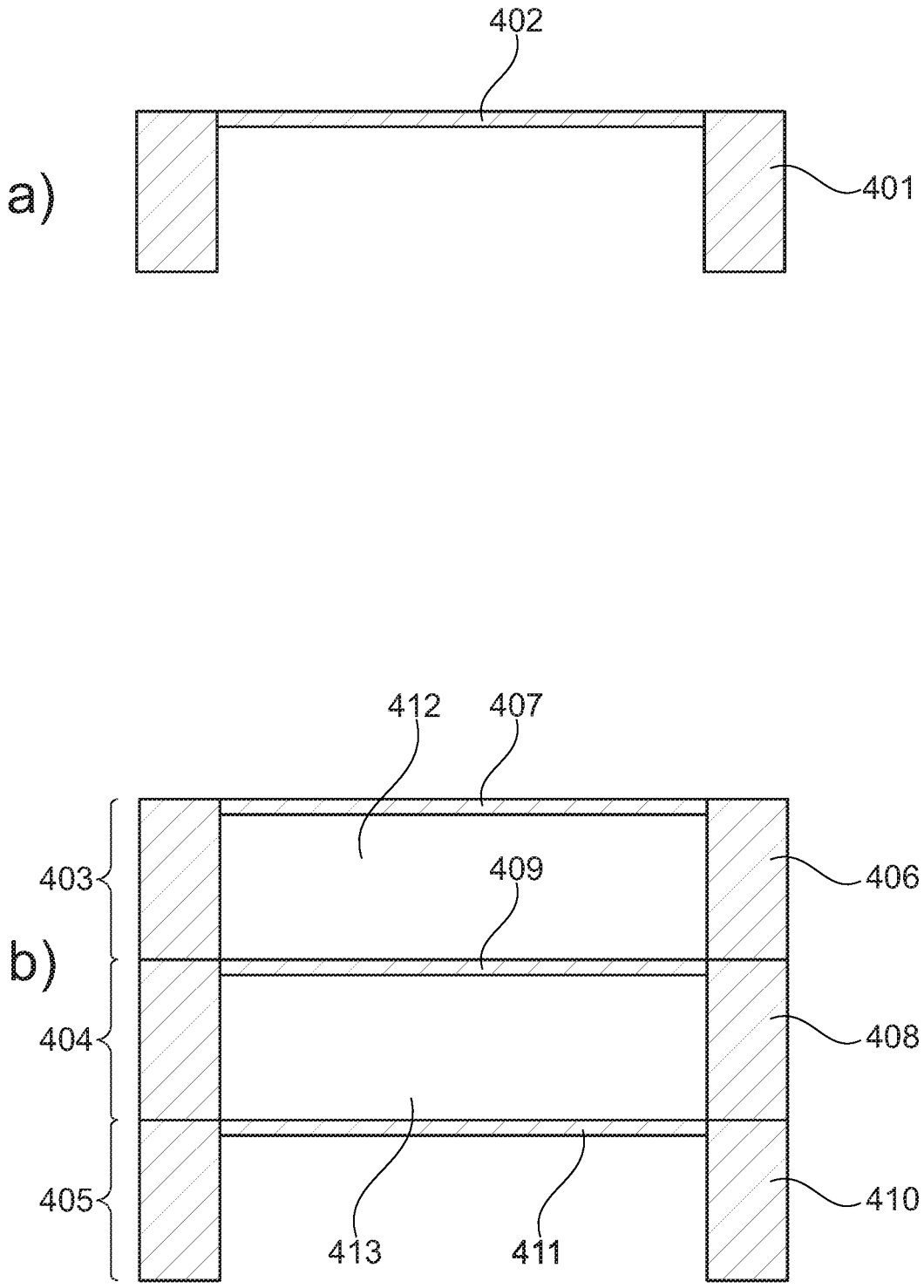
FIG. 4 shows a single MEMS die, and a triple-stacked MEMS die.

Referring now to FIG. 4*a* an embodiment in the form of a single MEMS die 401 comprising a moveable diaphragm 402 is depicted. The moveable diaphragm 402 may be of the type disclosed in connection with FIG. 2 (piezoelectric), FIG. 3 (electrostatic) or a completely different type of moveable diaphragm. Turning now to FIG. 4*b* an embodiment comprising three stacked 403, 404, 405 MEMS dies 406, 408, 410 is depicted. Each of the MEMS dies 406, 408, 410 comprises respective moveable diaphragms 407, 409, 411 which are coupled in series. Intermediate volumes 412, 413 are provided between moveable diaphragms 407, 409 and between moveable diaphragms 409, 411. The stacked MEMS dies 406, 408, 410 shown in FIG. 4*b* are similar in size and may therefore be stacked directly onto each other.

As previously addressed a low acoustic compliance of the intermediate volumes 412, 413 relative to the acoustic compliances of the moveable diaphragms 407, 409, 411 ensures that movements of the moveable diaphragms 407, 409, 411 are locked through a substantially rigid connection. Thus, a movement of one diaphragm in one direction will provide a force in the same direction to the other diaphragms. The intermediate volumes thus act as a stiff connection between the moveable diaphragms 407, 409, 411 thus transferring forces between them as well as ensuring that the moveable diaphragms 407, 409, 411 perform similar volume displacements in response to an applied electrical drive signal. The drive structures of the moveable diaphragms 407, 409, 411 are electrically coupled in parallel so that a common electrical drive signal can be applied to the drive structures of the moveable diaphragms 407, 409, 411.

Stacking of MEMS dies as depicted in FIG. 4*a* is advantageous in that more diaphragm area may be easily provided when a plurality of diaphragms are arranged in series.

Figure 5:
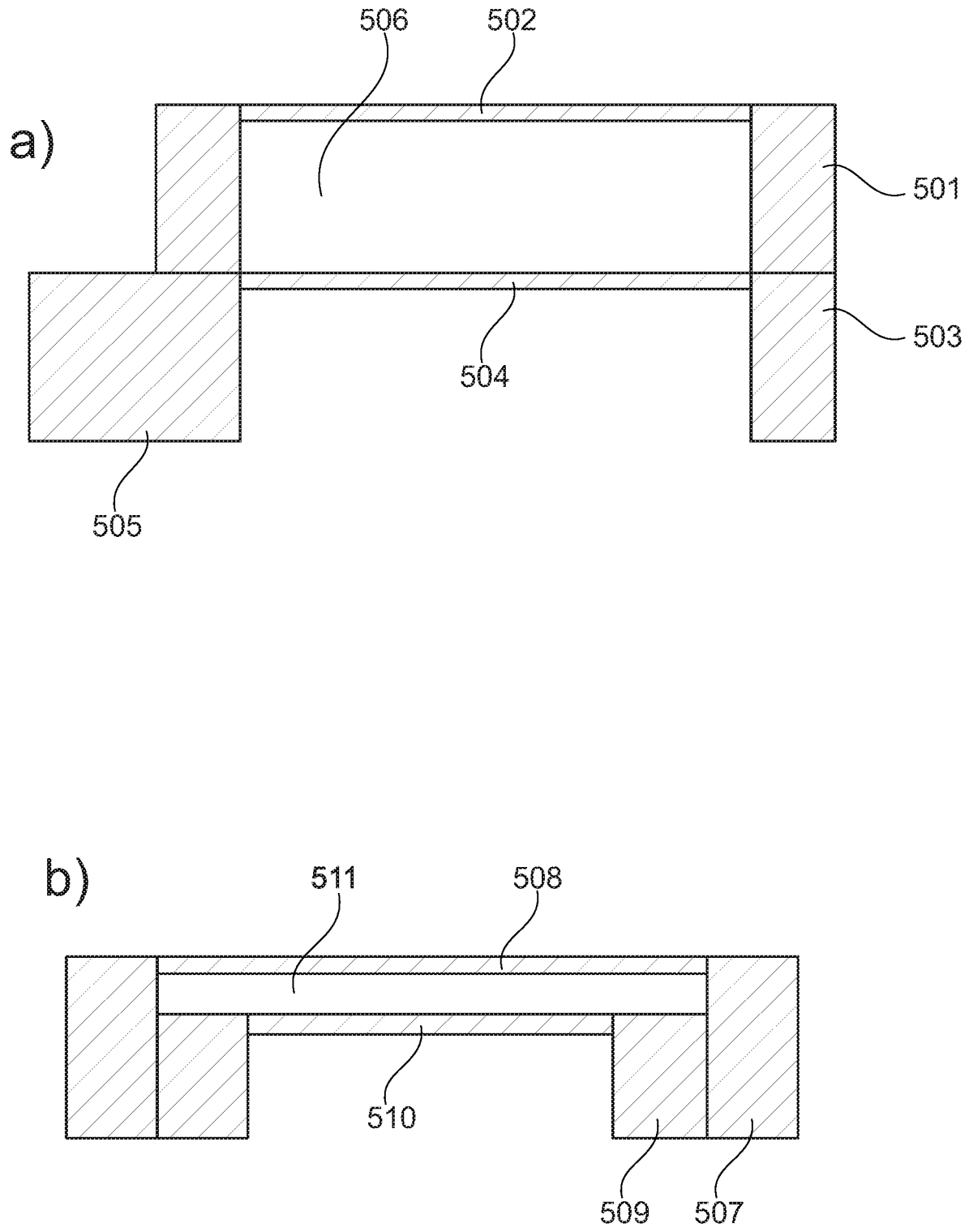
FIG. 5 shows a double-stacked MEMS die, and a die-in-die MEMS die.

Referring now to FIG. 5*a* an embodiment comprising two stacked MEMS dies 501, 503 is depicted. Each of the MEMS dies 501, 503 comprises respective moveable diaphragms 502, 504 which are arranged in series. An intermediate volume 506 is provided between moveable diaphragms 502, 504. Contrary to the arrangement shown in FIG. 4*b* the stacked MEMS dies shown in FIG. 5*a* have different outer dimensions due to the enlarged support structure 505. The intermediate volume 506 acts as discloses above, i.e. as a stiff connection between the moveable diaphragms 502, 504 thus transferring forces between them as well as ensuring that the moveable diaphragms 502, 504 perform similar volume displacements in response to an applied electrical drive signal.

FIG. 5*b* shows an embodiment where one MEMS die 509 is arranged in the hollow portion of another MEMS die 507. Again, each of the MEMS dies 507, 509 comprises respective moveable diaphragms 508, 510 which are arranged in series. An intermediate volume 511 is provided between moveable diaphragms 508, 510. The intermediate volume 511 acts as discloses above, i.e. as a stiff connection between the moveable diaphragms 508, 510. An immediate advantage of the embodiment shown in FIG. 5*b* is its limited height due to the die-in-die arrangement.

Figure 6:
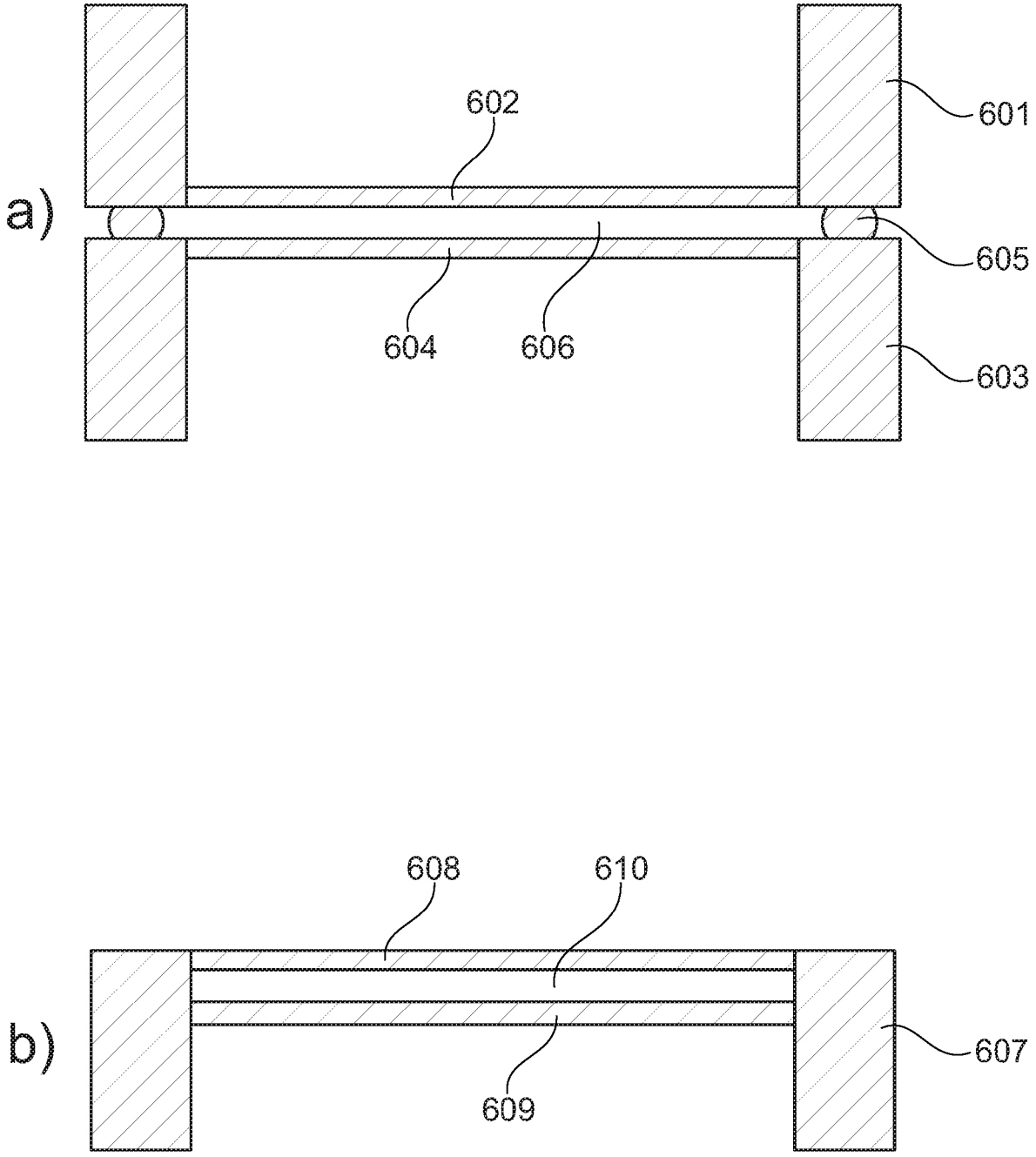
FIG. 6 shows flip-clip mounted MEMS dies, and a double-layer MEMS die.

Referring now to FIG. 6*a* an embodiment comprising two flip-chip mounted MEMS dies 601, 603 is depicted. Each of the MEMS dies 601, 602 comprises respective moveable diaphragms 602, 604 which are arranged in series. An intermediate volume 606 is provided between moveable diaphragms 602, 604. The intermediate volume 606 acts as discloses above, i.e. as a stiff connection between the moveable diaphragms 602, 604. The MEMS dies 601, 603 are attached to each other via die attachment 605. In FIG. 6*b* an embodiment comprising a MEMS die 607 having two moveable diaphragms 608, 609 separated by an intermediate volume 610 is depicted. Again, the intermediate volume 610 acts as a stiff connection between the moveable diaphragms 602, 604.

Figure 7:
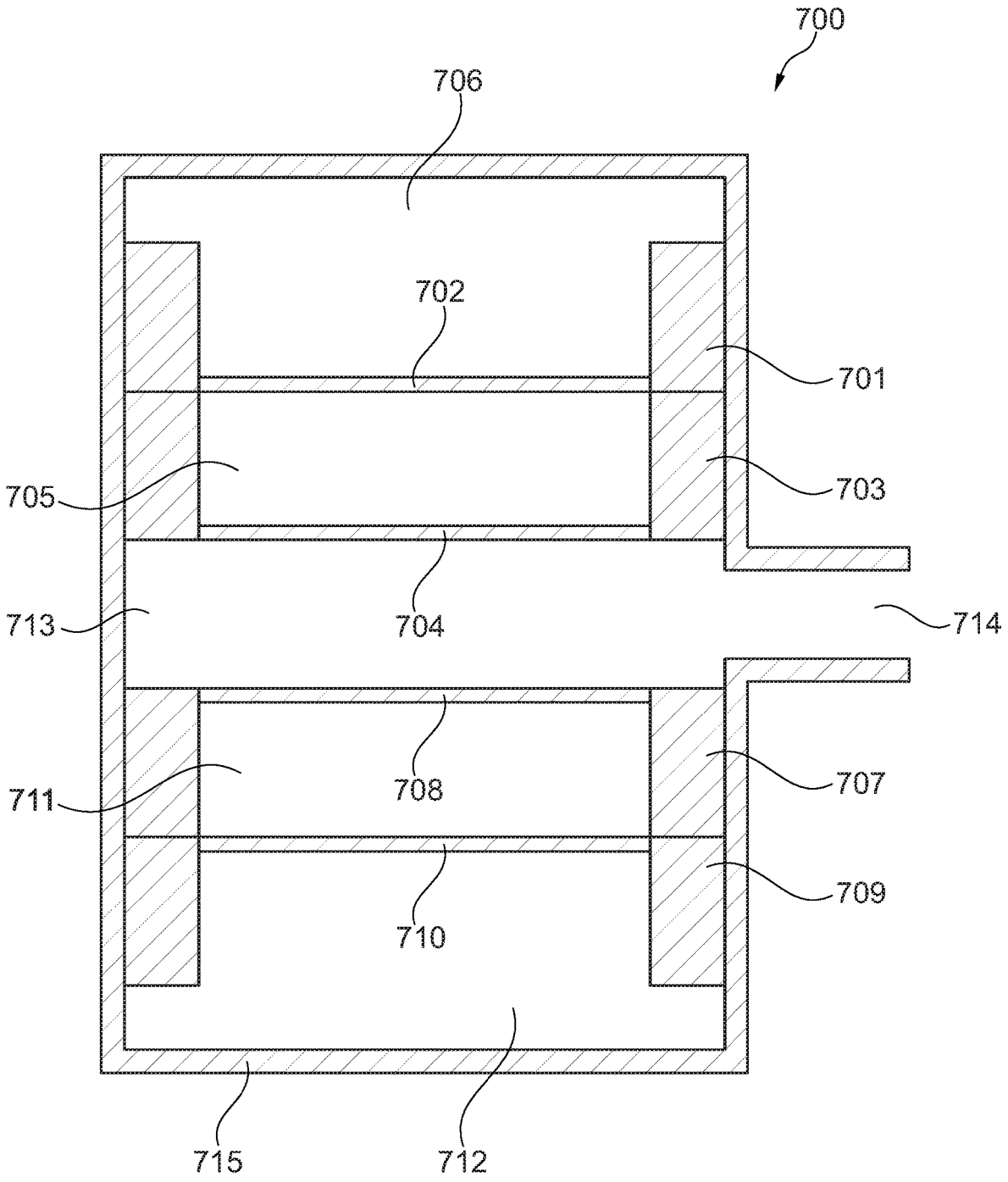
FIG. 7 shows two double-stacked MEMS dies in a package.

FIG. 7 shows a miniature receiver 700 comprising a receiver housing 715 having a sound outlet 714 being acoustically connected to a common front volume 713. Two MEMS assemblies each comprising two MEMS dies 701, 703 and 707, 709 are arranged within the receiver housing 715. As seen in FIG. 7 the upper MEMS assembly comprises two MEMS die 701, 703 which each comprises respective moveable diaphragms 702, 704 which are arranged in series. An intermediate volume 705 is provided between moveable diaphragms 702, 704. The intermediate volume 705 acts as a stiff connection between the moveable diaphragms 702, 704. A first rear volume 706 is provided behind the moveable diaphragm 702. Similarly, the lower MEMS assembly comprises two MEMS die 707, 709 which each comprises respective moveable diaphragms 708, 710 which are arranged in series. Again, an intermediate volume 711 is provided between moveable diaphragms 708, 710. The intermediate volume 711 acts as a stiff connection between the moveable diaphragms 708, 710. A second rear volume 712 is provided behind the moveable diaphragm 702. The drive structure of the four moveable diaphragms 702, 704, 708, 710 are adapted to be driven by the same drive signal.

Figure 8:
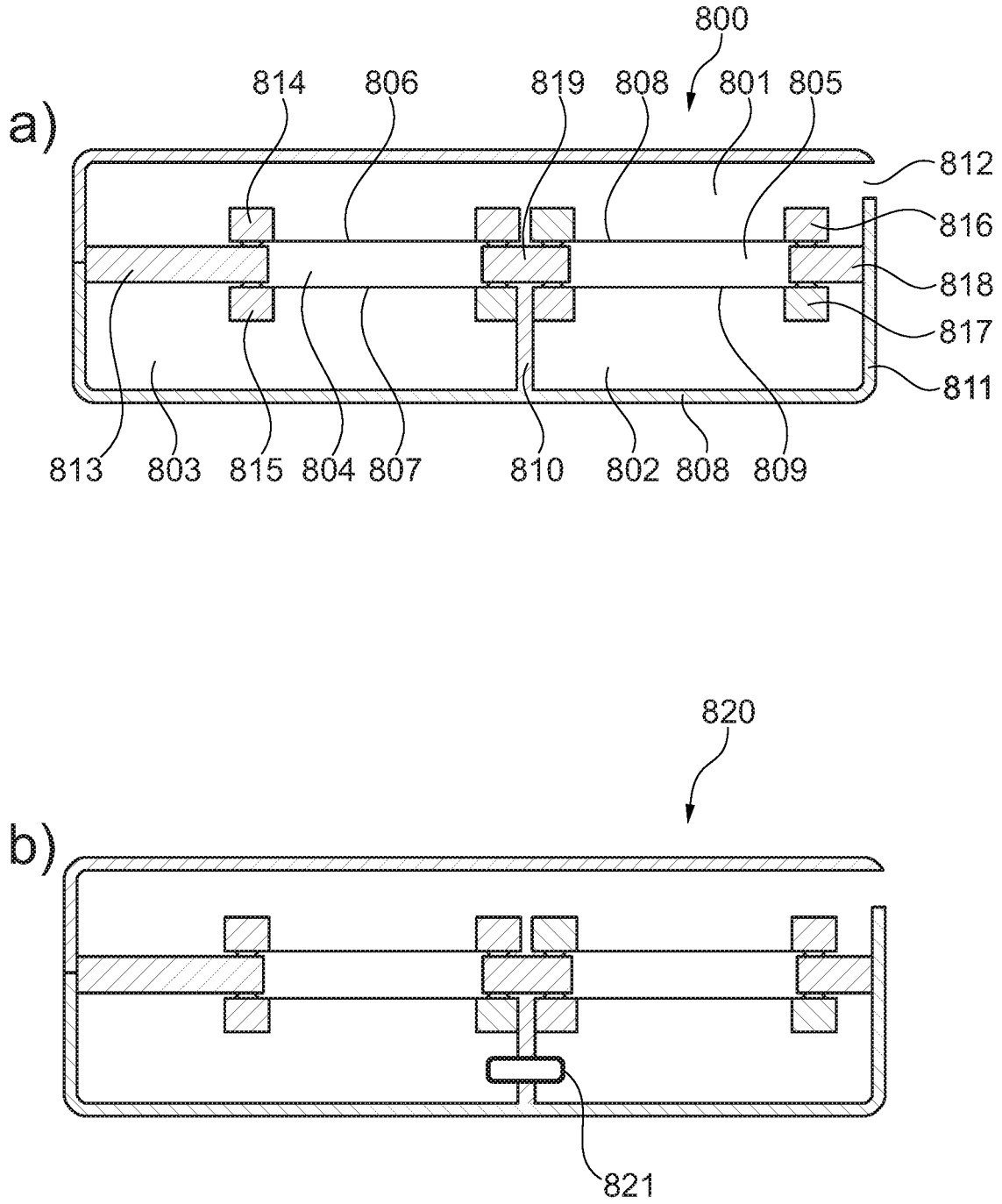
FIG. 8 shows a miniature receiver applying two double-stacked MEMS dies.

Referring now to FIG. 8*a* another embodiment 800 of the present invention is depicted. As seen in FIG. 8*a* the miniature receiver 800 comprises a housing 811 and a sound outlet 812 arranged therein. The sound outlet 812 is acoustically connected to a front volume 801 which is acoustically sealed from two rear volumes 802, 803 via substrate portions 813, 818, 819 and first, second, third and fourth MEMS dies 814, 815, 816, 817. The two rear volumes 802, 803 are acoustically separated from each other by the wall 810. The MEMS dies 814, 815, 816, 817 are all aligned with openings in the substrate portions as well as secured to the substrate portions 813, 818, 819 via respective die attachments.

As seen in FIG. 8*a* a first moveable diaphragm 806 forms part of the MEMS die 814, whereas a second moveable diaphragm 807 forms part of the MEMS die 815. The first and second moveable diaphragms 806, 807 are arranged in a substantially parallel manner. Similarly, a third moveable diaphragm 808 forms part of the MEMS die 816, whereas a fourth moveable diaphragm 809 forms part of the MEMS die 817. The third and fourth moveable diaphragms 808, 809 are arranged in a substantially parallel manner.

The upper surfaces of the first and third moveable diaphragms 806, 808 are acoustically connected to the front volume 801, whereas the opposing lower surfaces of the first and third moveable diaphragms 806, 808 are acoustically connected to the intermediate volumes 804, 805, respectively. Similarly, the upper surfaces of the second and fourth moveable diaphragms 807, 809 are acoustically connected to the respective intermediate volumes 804, 805, whereas the opposing lower surfaces of the second and fourth moveable diaphragms 807, 809 are acoustically connected to respective rear volumes 803, 802.

As mentioned above the intermediate volumes 804, 805 both have an acoustic compliance which is smaller than the respective acoustic compliances of the first, second, third and fourth moveable diaphragms 806-809. The smaller acoustic compliance of the intermediate volumes 804, 805 relative to the acoustic compliances of the moveable diaphragms 806-809 ensure that the first and second moveable diaphragms 806, 807 are driven in the same direction and perform the same volume displacements in response to an applied electrical drive signal. The same applies to the third and fourth moveable diaphragms 808, 809.

The moveable diaphragms 806-809 each comprises an integrated drive structure being adapted to displace the moveable diaphragms 806-809 in response to applied electrical drive signals. Although not shown in FIG. 8*a* the integrated drive structure of each of the moveable diaphragms 806-809 may comprise a piezoelectric material layer being arranged between a first and a second electrode. The first and second electrodes of the respective moveable diaphragms 806-809 are electrically coupled in parallel so that an electrical drive signal applied to the first moveable diaphragm 806 is also applied to the second moveable diaphragm 807. Similarly, an electrical drive signal applied to the third moveable diaphragm 808 is also applied to the fourth moveable diaphragm 809. In fact the same electrical drive signal may be applied to all moveable diaphragms.

The piezoelectric arrangement for driving the moveable diaphragms 806-809 may be implemented as depicted in FIG. 2. Alternatively, the drive mechanism for driving the moveable diaphragms 806-809 may be implemented as an electrostatic arrangement each having an associated backplate as depicted in FIG. 3.

Referring now to the embodiment 820 depicted in FIG. 8*b* an acoustical filter 821 has been inserted between the two rear volumes (reference numerals 802, 803 in FIG. 8*a*). The acoustical filter 821 may be implemented in various ways, including a mesh structure for attenuating sound pressure. Despite the acoustical filter 821 the embodiment shown in FIG. 8*b* is identical to the embodiment shown in FIG. 8*a*.

Figure 9:
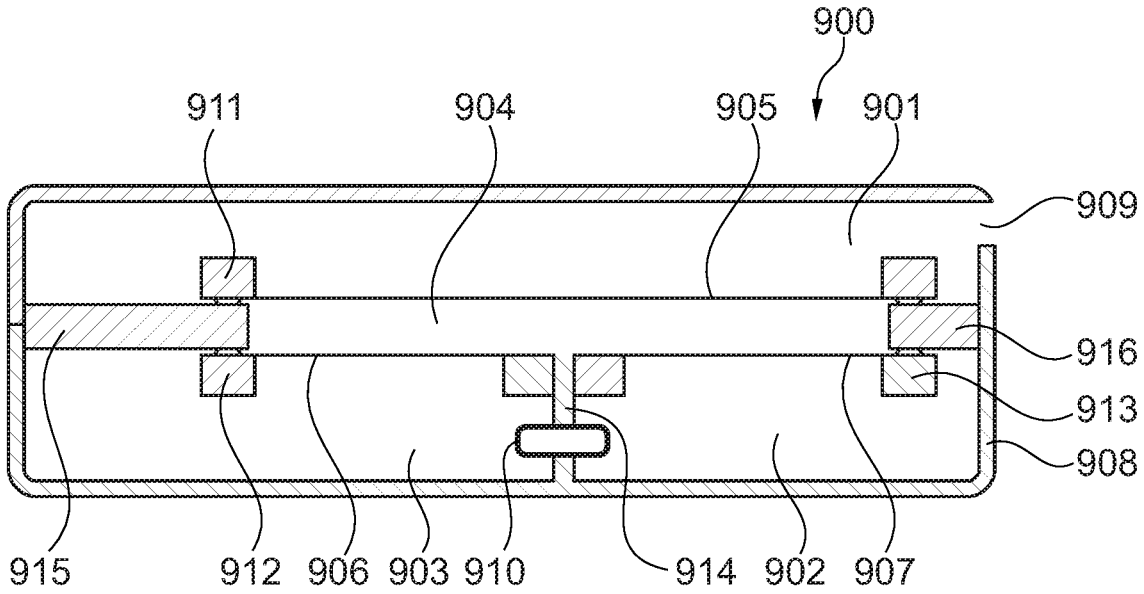
FIG. 9 shows a miniature receiver applying stacked MEMS dies.

Turning now to FIG. 9 another embodiment 900 of the present invention is depicted. As seen in FIG. 9 the miniature receiver 900 comprises a housing 908 and a sound outlet 909 arranged therein. The sound outlet 909 is acoustically connected to a front volume 901 which is acoustically sealed from two rear volumes 902, 903 via substrate portions 915, 916 and first, second, and third MEMS dies 911-913. The two rear volumes 902, 903 are acoustically connected via the acoustical filter 910 which is arranged in the wall 914. The MEMS dies 911-913 are all aligned with openings in the substrate portions 915, 916 as well as secured to the substrate portions 915, 916 via respective die attachments.

As seen in FIG. 9 a first moveable diaphragm 905 forms part of the MEMS die 911, whereas second and third moveable diaphragms 906, 907 form part of respective MEMS dies 912, 913. The first, second and third moveable diaphragms 905-907 are arranged in a substantially parallel manner.

The upper surface of the first moveable diaphragm 905 is acoustically connected to the front volume 901, whereas the opposing lower surface of the first moveable diaphragm 905 is acoustically connected to the intermediate volume 904. Similarly, the upper surfaces of the second and third moveable diaphragms 906, 907 are acoustically connected to the intermediate volume 904, whereas the opposing lower surfaces of the second and third moveable diaphragms 906, 907 are acoustically connected to respective rear volumes 903, 902.

The intermediate volume 904 has an acoustic compliance which is smaller than the respective acoustic compliances of the first, second and third moveable diaphragms 905-907. As previously addressed the smaller acoustic compliance of the intermediate volumes 904 relative to the acoustic compliances of the moveable diaphragms 905-907 ensure that the moveable diaphragms 905-907 are driven in the same direction and that the first moveable diaphragm 905 perform the same volume displacements as the second and third moveable diaphragms 906, 907 in combination in response to an applied electrical drive signal.

Similar to the previous embodiments the moveable diaphragms 905-907 each comprises an integrated drive structure being adapted to displace the moveable diaphragms 905-907 in response to applied electrical drive signals. Although not shown in FIG. 9 the integrated drive structure of each of the moveable diaphragms 905-907 may comprise a piezoelectric material layer being arranged between a first and a second electrode. The first and second electrodes of the respective moveable diaphragms 905-907 are electrically coupled in parallel so that an electrical drive signal applied to the first moveable diaphragm 905 is also applied to the second and third moveable diaphragm 906, 907. It should however be noted that other electrical connections may also be applicable.

The piezoelectric arrangement for driving the moveable diaphragms 905-907 may be implemented as depicted in FIG. 2. Alternatively, the drive mechanism for driving the moveable diaphragms 905-907 may be implemented as an electrostatic arrangement each having an associated backplate as depicted in FIG. 3. It should be noted that electret based structures may be applied as well.

The invention claimed is:

1. A miniature receiver comprising a first moveable diaphragm being acoustically connected to an intermediate volume, and a second moveable diaphragm being acoustically connected to the intermediate volume and a rear volume, wherein the acoustic compliance of the intermediate volume is smaller than the acoustic compliances of the respective first and second moveable diaphragms, and wherein the acoustic compliance of the intermediate volume ensures that the first and second moveable diaphragms are driven in the same direction and perform the same volume displacements in response an electrical drive signal.

2. A miniature receiver according to claim 1, further comprising a front volume, wherein a first surface of the first moveable diaphragm is acoustically connected to the front volume, and wherein an opposing second surface of the first moveable diaphragm is acoustically connected to the intermediate volume, and wherein a first surface of the second moveable diaphragm is acoustically connected to the intermediate volume, and wherein an opposing second surface of the second moveable diaphragm is acoustically connected to the rear volume.

3. A miniature receiver according to claim 2, wherein the front volume is acoustically connected to a sound outlet of the miniature receiver.

4. A miniature receiver according to claim 2, wherein the first moveable diaphragm forms part of a first MEMS die, and wherein the second moveable diaphragm forms part of a second MEMS die.

5. A miniature receiver according to claim 2, wherein the first and second moveable diaphragms form part of the same MEMS die.

6. A miniature receiver according to claim 4, wherein the first and second MEMS dies are arranged on opposing surfaces of a substrate at least partly separating the front and rear volumes.

7. A miniature receiver according to claim 1, wherein the first and/or second moveable diaphragms each comprises a substantially plane diaphragm comprising an integrated drive structure.

8. A miniature receiver according to claim 7, wherein the integrated drive structure comprises a piezoelectric material layer arranged between a first and a second electrode, and wherein the first and second electrodes of the respective first and second moveable diaphragms are electrically coupled in parallel.

9. A miniature receiver according to claim 1, wherein the first and/or second moveable diaphragms each comprises a substantially plane electrostatic diaphragm.

10. A miniature receiver according to claim 1, wherein the first and second moveable diaphragms comprise respective first and second substantially plane diaphragms, said first and second substantially plane diaphragms being structurally arranged in a substantially parallel manner.

11. A miniature receiver according to claim 1, further comprising additional moveable diaphragms being arranged in series with the first and second moveable diaphragms.

12. A personal device comprising a miniature receiver according to claim 1, said personal device being selected from the group consisting of hearing aids, hearing devices, hearables, mobile communication devices and tablets.

13. A miniature receiver according to claim 3, wherein the acoustic compliance of the intermediate volume ensures that the first and second moveable diaphragms are driven in the same direction and perform the same volume displacements in response an electrical drive signal.

* * * * *